US007985935B2

(12) United States Patent
Sanford

(10) Patent No.: US 7,985,935 B2
(45) Date of Patent: Jul. 26, 2011

(54) BOTTOM ACTUATED SWITCH

(75) Inventor: Emery Sanford, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 374 days.

(21) Appl. No.: 12/178,571

(22) Filed: Jul. 23, 2008

(65) Prior Publication Data

US 2009/0078555 A1 Mar. 26, 2009

Related U.S. Application Data

(60) Provisional application No. 60/995,366, filed on Sep. 25, 2007.

(51) Int. Cl.
*H01H 9/00* (2006.01)

(52) U.S. Cl. ..... 200/292; 200/331; 200/547

(58) Field of Classification Search ..... 200/292
See application file for complete search history.

(56) References Cited

U.S. PATENT DOCUMENTS 3,369,100 A * 2/1968 Kussy et al. ..... 200/330
3,751,613 A * 8/1973 Inose et al. ..... 200/61.08
5,552,964 A * 9/1996 Naito ..... 361/781
7,148,430 B2 * 12/2006 Toyoda et al. ..... 174/536

* cited by examiner

*Primary Examiner* — Renee S Luebke
*Assistant Examiner* — Lisa Klaus
(74) *Attorney, Agent, or Firm* — Kramer Levin Naftalis & Frankel LLP

(57) ABSTRACT

The systems and methods described herein are directed to a switch for electronic devices. The systems and methods provide for a switch disposed on a bottom surface of a circuit board enclosed in a housing of an electronic device. The circuit board may include an aperture. An actuating pin of the switch may extend through the aperture towards the top surface of the circuit board. An external actuator may be coupled to the actuating pin in the aperture on the circuit board. The external actuator may extend out through an opening in the housing for providing a user with access to the switch.

17 Claims, 3 Drawing Sheets

BOTTOM ACTUATED SWITCH

CROSS-REFERENCE TO RELATED APPLICATIONS

This application claims the benefit of U.S. Provisional Patent Application Ser. No. 60/995,366, filed on Sep. 25, 2007, the entire contents of which are incorporated herein by reference in their entirety.

FIELD OF THE INVENTION

This invention is directed to switches for electronic devices having reduced thickness.

BACKGROUND OF THE INVENTION

Recent technological advances have facilitated the decrease in size of portable electronic devices such as portable music and video players. Engineers have been able to reduce the size of circuitry and electronic components in electronic hardware such as the storage, memory and power supply units. However, the overall size of these electronic devices is still influenced by the size and shape of its mechanical components such as enclosures, casing and switch components. These mechanical components pose several constraints on the reduction of the size of the devices. For example, switches used for powering or operating these devices can be relatively bulky because several mechanical components may be needed to transfer mechanical force applied by a user to switching an electrical circuit.

Moreover, the size, shape and configuration of a switch commonly influence the orientation of a circuit board, thereby impacting the overall size of the electronic device. In one example, a side activated switch is mounted parallel to the plane of the circuit board. Typically, users can access these switches on an exterior surface of the electronic device. However, because the switch is side activated, the circuit board has to be placed perpendicular to the exterior surface through which the user is accessing the switch. In such an arrangement, the circuit board extends away from the surface and into the body of the device, thereby increasing the length of the device.

Accordingly, there is a need for smaller and more compact switching assemblies.

SUMMARY OF THE INVENTION

The systems and methods described herein are directed to low profile switching for assemblies electronic devices. For purposes of clarity, and not by way of limitation, the systems and methods may be described herein in the context of switching assemblies or input mechanisms that are associated with electronic devices. However, it may be understood that the systems and methods described herein may be applied to any mechanical component associated with electronic devices.

Switching assemblies for electronic devices (e.g., a bottom actuated switch) are provided. The switching assemblies may include a switch disposed on a bottom surface of a circuit board. The circuit board may include an aperture through which an actuating pin of the switch may extend towards the top surface of the circuit board. An external actuator (e.g., cosmetic button) may be coupled to the actuating pin within the aperture on the circuit board. Such a switching assembly may allow a circuit board to be positioned close to the inside surface of the electronic device. Also, the thickness of the switching assembly may be reduced because a portion of the assembly (i.e. the actuating pin and the external actuator) may be coupled within the aperture in the circuit board.

More particularly, in one aspect of the invention, the systems and methods described may include a switch assembly for an electronic device. The switch assembly may include a housing, a circuit board disposed in the housing, a switch mounted on a surface of the circuit board and an external actuator coupled to the switch. The housing may include an opening on a surface. The circuit board may include an aperture near the opening of the housing. In some embodiments, the switch may be mounted on a surface of the circuit that is distal to the opening and overlapping with the aperture. The switch may include an actuating pin extending through the aperture. The external actuator may be disposed on a surface of the circuit board proximal to the opening and extending through the aperture. The external actuator may be coupled to the pin to allow a user to operate the switch.

In another aspect of the invention, the housing has a thickness dimension of about 5 mm, and the opening may be on a surface of the housing substantially along the thickness dimension of the device. The circuit board may be disposed in an orientation whereby the surface of the circuit board is substantially parallel to the surface of the housing that includes the opening.

In another aspect of the invention, the systems and methods described may include a switch assembly for a printed circuit board. The switch assembly may include a printed circuit board having a top surface, a bottom surface and an aperture extending from the top surface to the bottom surface. The switch assembly may further include a switch mounted on the top surface overlapping the aperture. The switch may include an actuating pin extending through the aperture towards the bottom surface. In some embodiments, the assembly may additionally include an external actuator disposed on the bottom surface over the aperture. The external actuator may be removably attached to the actuating pin. The external actuator may extend into the aperture. In some embodiments, the actuating pin may not extend past the bottom surface.

In some embodiments, the switch may include a slide-switch and the aperture may be adapted to allow the actuating pin to slide between different switch positions. For example, the aperture may be adapted to allow a portion of the external actuator to slide between different switch positions. In some embodiments, the printed circuit board may include several apertures, and several switches may be mounted on the top surface overlapping the several apertures. Several external actuators may be disposed on the bottom surface such that each actuator may engage an actuating pin of a switch that extends through one of the several apertures.

In yet another aspect of the invention, the systems and methods may include methods for manufacturing a switch assembly. The methods may include providing a printed circuit board and a switch. The printed circuit board may have a top surface, a bottom surface and an aperture extending from the top surface to the bottom surface. The aperture may be located near a portion of the top surface having circuitry for switching. The switch may be configured to be mounted on the top surface for connecting to the circuitry. The switch may include an actuating pin adapted to extend in a direction substantially perpendicular to the top surface when the switch is mounted. The methods may further include mounting the switch on the top surface and overlapping the aperture such that the actuating pin may extend through the aperture and towards the bottom surface. In some embodiments, an external actuator may be coupled to the actuating pin.

In some embodiments, the methods may further include providing a housing having an opening on a surface. The methods may include enclosing the circuit board and the switch within the housing such that the external actuator extends through the opening on the surface of the housing.

In another aspect of the invention, the systems and methods described herein may include switch assemblies for printed circuit boards. The switch assemblies may include a printed circuit board having a top surface, a bottom surface and an aperture extending from the top surface to the bottom surface. The switch assemblies may include a switch mounted on the top surface overlapping the aperture. The switch may include an actuating pin extending through the aperture towards the bottom surface. In some embodiments, the switch may include a slide-switch and the aperture may be adapted to allow the actuating pin to slide between different switch positions. The switch assembly may include a housing having an opening on a surface. The printed circuit board and the switch may be disposed within the housing such that a portion of the actuating pin may be accessible through the opening on the housing.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION

As will be seen from the following description, the systems and methods provide for a switch disposed on a bottom surface of a circuit board enclosed in a housing of an electronic device. The circuit board may include an aperture and an actuating pin of the switch that extends through the aperture towards the top surface of the circuit board. An external actuator may be coupled to the actuating pin in the aperture on the circuit board. The external actuator may extend out through an opening in the housing for providing a user with access to the switch.

Figure 1:
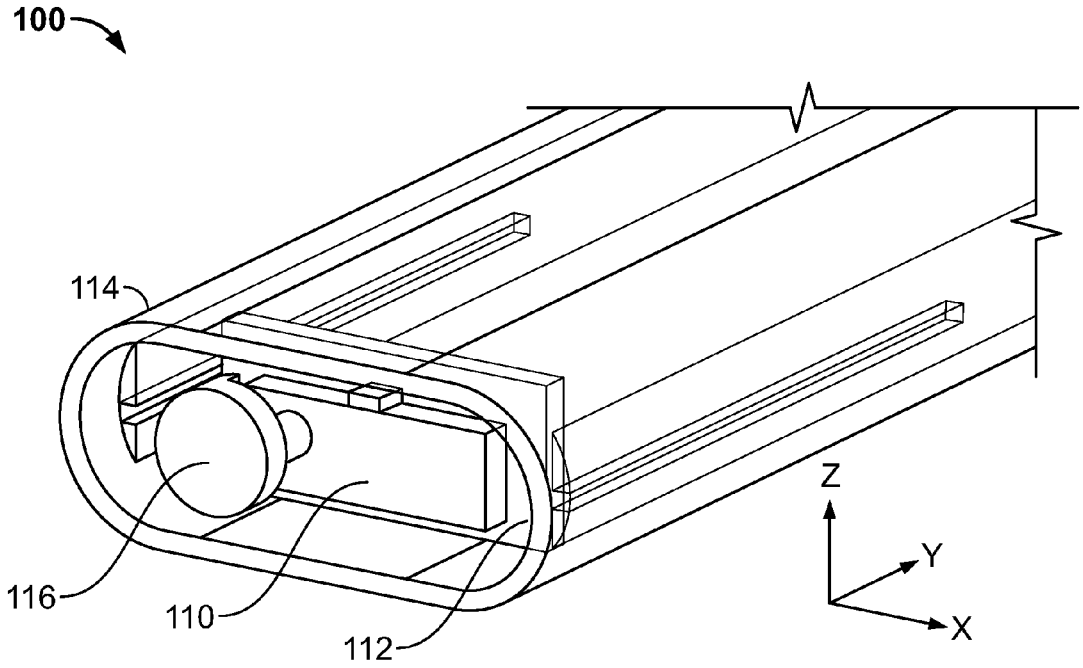
FIG. 1 is a schematic view of a slide switch vertically mounted in a small enclosure in accordance with one embodiment of the invention.

FIG. 1 is a schematic view of a switch vertically mounted in a small enclosure in accordance with one embodiment of the invention. Electronic device 100 may include switch 110, which may be a slide switch mounted to circuit board 112 disposed within the enclosure or housing 114. An external actuator 116 may be coupled to switch 110 to allow a user to change the state of the switch. Electronic device 100 may have a small overall thickness Z (e.g., 5 mm). To minimize length Y of electronic device 100, circuit board 112 may be mounted vertically (e.g., the plane of circuit board 112 is perpendicular to Y). In some embodiments, the size of circuit board 112 and switch 100 may be reduced to prevent width X of electronic device from becoming excessively large.

Housing 114 may form the outer surface of an electronic device or electronic component, for example the outer surface of a portable media device (e.g., an iPod available from Apple Inc. of Cupertino, Calif.), or a portable media device accessory (e.g., an audio controller for a portable media device or an in-line microphone with an input mechanism). Housing 114 may be manufactured from any suitable material using any suitable manufacturing process. For example, housing 114 may be manufactured from a metal (e.g., aluminum or stainless steel), plastic, a composite material, or any other suitable material. In some embodiments, actuator 116 may be finished (e.g., polished, etched, or decorated) to provide an aesthetically pleasing and cosmetic surface. Actuator 116 may be constructed from any suitable material, including for example metal (e.g., aluminum or steel), plastic, a composite material, an elastomer, or any other suitable material.

Figure 2:
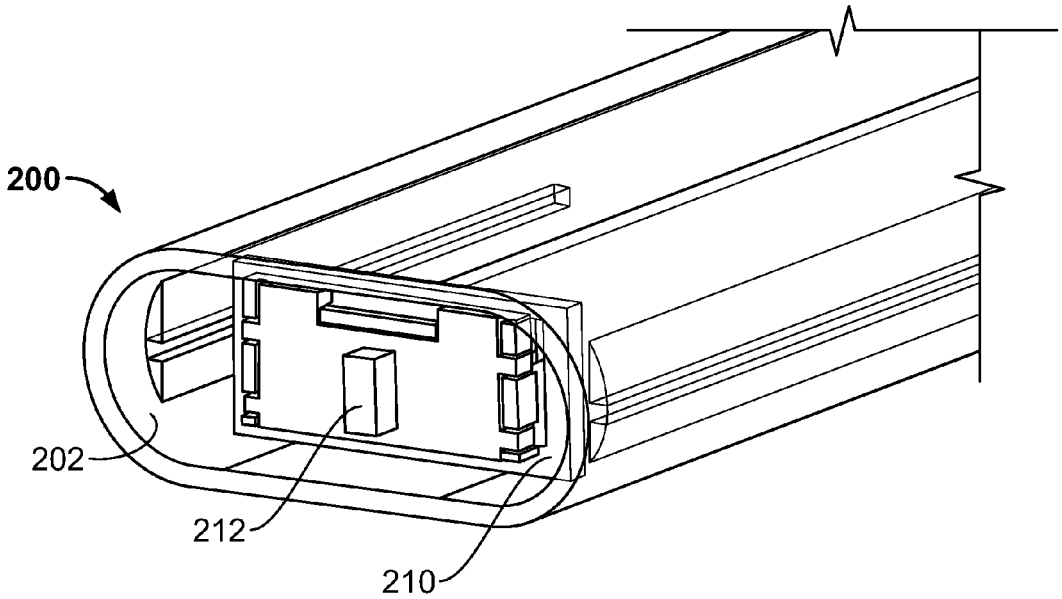
FIG. 2 is a schematic view of an electronic device with a top-actuated switch in accordance with one embodiment of the invention.

The switch may be actuated using any suitable approach. FIG. 2 is a schematic view of an electronic device with a top-actuated switch in accordance with one embodiment of the invention. Electronic device 200 may include circuit board 212, which may be mounted vertically in electronic device 200 (e.g. to reduce the length required for electronic device 200 to accommodate switch 210). Switch 210 may be coupled to the surface of circuit board 212 facing opening 202 of electronic device 200 (e.g., placed on the top of circuit board 212, and thus top-actuated). To actuate switch 210, an external actuator located adjacent to opening 202 may be coupled (e.g., mechanically or electrically) to switch 210. Although such an approach may be effective, it may add to the length (e.g., Y dimension, FIG. 1) of electronic device 200 because the height of the actuator may be added to the height of switch 210.

Figure 3A:
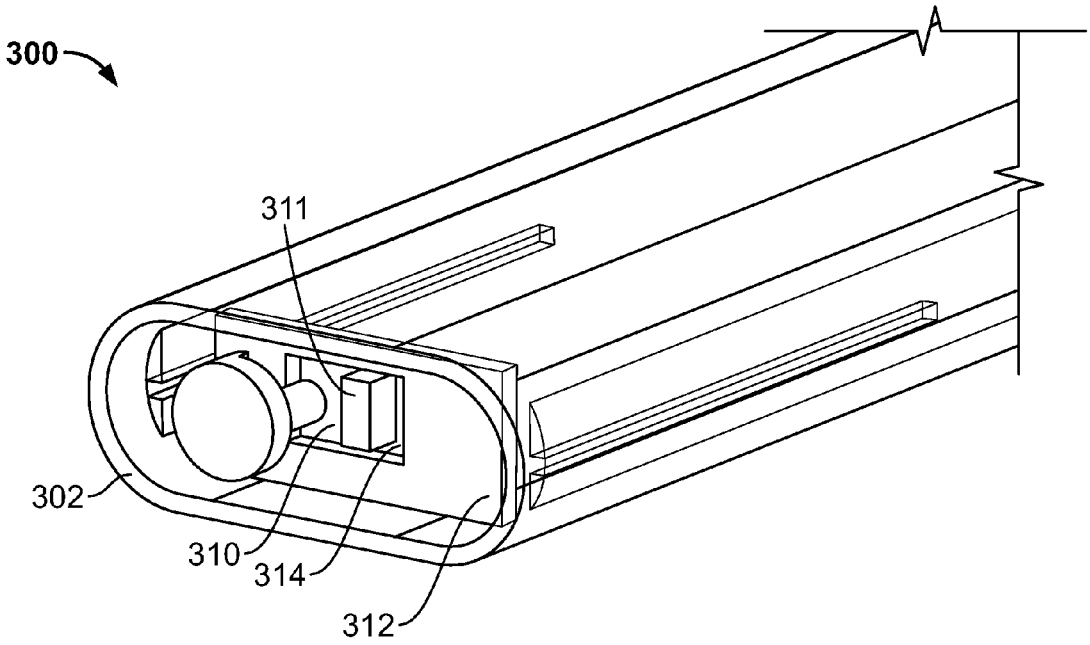
FIGS. 3A and B are schematic views of an electronic device with a bottom-actuated switch in accordance with one embodiment of the invention.
Figure 3B:
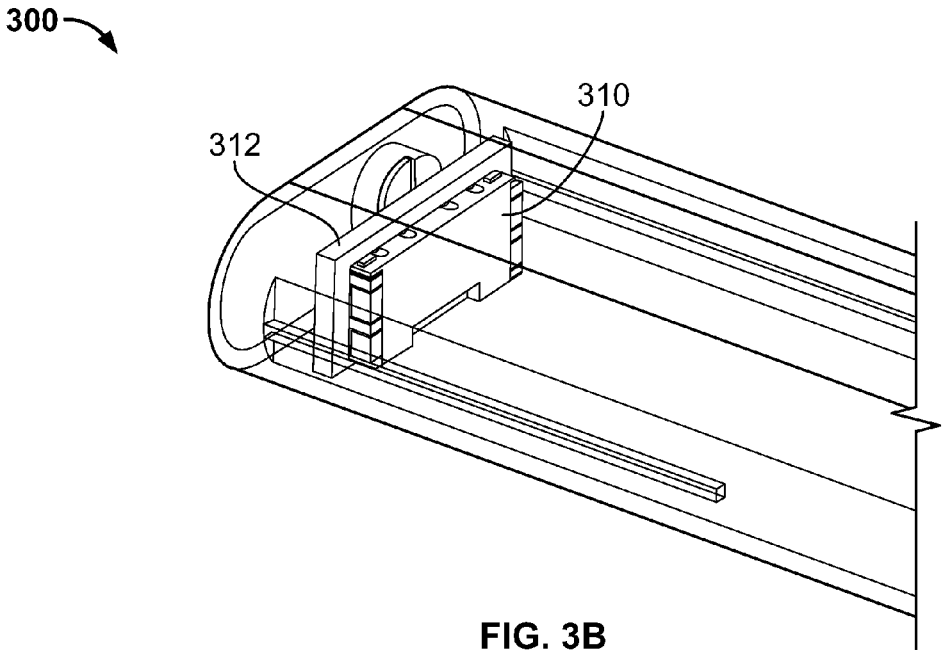

In some embodiments, the switch may instead be placed on the bottom surface of the circuit board. FIGS. 3A and B are schematic views of an electronic device with a bottom-actuated switch in accordance with one embodiment of the invention. Electronic device 300 may include circuit board 312, which may be mounted vertically in electronic device 300 to reduce the length required to accommodate switch 310 in electronic device 300. Circuit board 312 may face opening 302 of electronic device 300, and switch 310 may be coupled to the side of circuit board 310 facing away from, or distal to opening 302. To provide access to switch 310 from opening 302, circuit board 310 may include aperture 314 through which actuating pin 311 may be accessed. Thus switch 310 may be actuated via the bottom surface of switch 310 (e.g., the surface in contact with circuit board 312). Using such a bottom-actuated switch 310 may reduce the overall profile of switch 310, as the external actuator needed to change the state of switch 310 may at least partially extend into aperture 314. By nesting the external actuator in circuit board 312, the overall Y length of electronic device 300 may be reduced by the amount by which the external actuator extends into circuit board 312. In addition, reducing the amount by which the actuator extends above circuit board 312 may allow external circuit board 112 to be mounted closer to opening 302.

Figure 4:
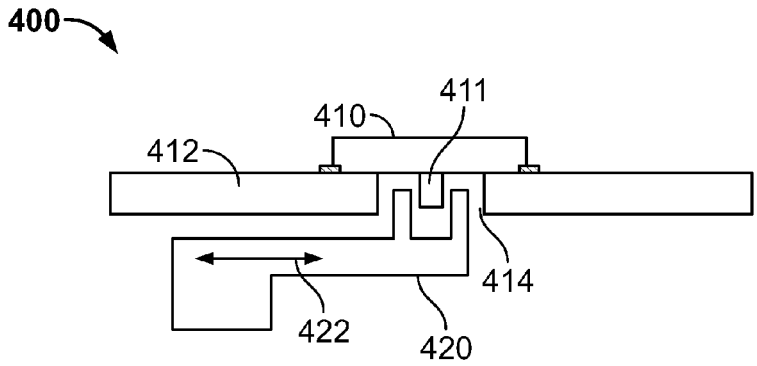
FIG. 4 is a schematic view of a bottom actuated switch in accordance with one embodiment of the invention.

Aperture 314 may be any suitable size. In some embodiments, aperture 314 may be defined such that actuating pin 311, once coupled to an external actuator, can move between defined states of switch 310 without encumbrances. In some embodiments, aperture 314 may be sized such that a portion of the body of the switch 310 may extend into the aperture 314. In such embodiments, the switch 310 may be positioned in a tilted orientation such that a portion of the body of the switch 310 is in the aperture 314 and a portion of the body of the switch is outside the aperture 314. In some embodiments, the switch 310 may be disposed such that a perimeter portion of the switch 310 is seated on the perimeter of the aperture 314 and a central portion of the switch 310 extends into the aperture 314. FIG. 4 is a schematic view of a bottom actuated switch in accordance with one embodiment of the invention. Switch 410 may be mounted to the bottom surface of circuit board 412. Switch 410 may include actuating pin 411, which may be actuated by external actuator 420 to change the state of switch 410. Actuating pin 411 may extend through aperture 414 of circuit board 412, such that actuator 420 may engage actuating pin 411 within the space defined by aperture 414. In some embodiments, the length of actuating pin 411 may be selected based at least on the thickness of the printed circuit board 412 and/or other suitable factors such as aesthetics. For example, actuating pin 411 may be extended in length such that actuating pin 411 may function as an external actuator 420. In such an example, a user may change the state of the switch by directly moving actuating pin 411. The size (e.g., length) of aperture 414 may be selected such that as actuator 420 moves in directions 422, actuating pin 411 may move to the different states of switch 410 (e.g., on/off).

In some embodiments, several circuit boards 412 may be stacked together. Each circuit board 412 may have an aperture that may be substantially aligned with one another. In such embodiments, one or more switches 410 may be connected to several circuit boards 412. For example, one switch 410 may be connected to two circuit boards 412 such that actuating pin 411 of the switch 410 extends through the apertures of both circuit boards 412.

Figure 5:
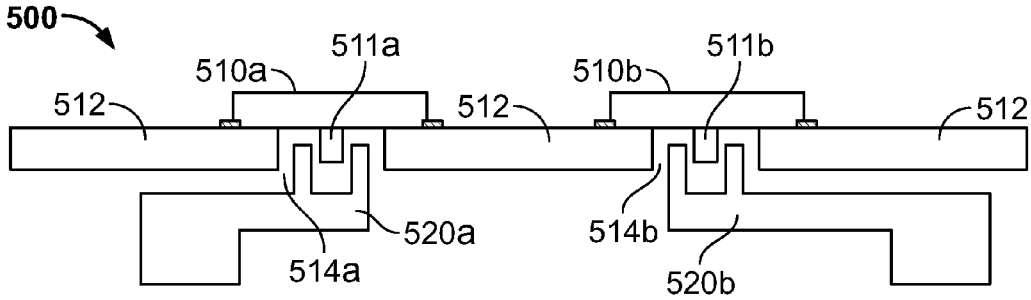
FIG. 5 is a schematic view of a bottom actuated switch in accordance with one embodiment of the invention.

In some embodiments, several switches may be connected to a printed circuit board. FIG. 5 is a schematic view of a bottom actuated switch in accordance with another embodiment of the invention. Switches 510*a* and 510*b* may be mounted to the bottom surface of circuit board 512. Switches 510*a* and 510*b* may include actuating pins 511*a* and 511*b*, respectively, which may be actuated by external actuators 520*a* and 520*b* to change the state of each of switches 510*a* and 510*b*. Pins 511*a* and 511*b* may extend through apertures 514*a* and 514*b*, respectively, of circuit board 512, such that actuators 520*a* and 520*b* may engage pins 511*a* and 511*b* within the space defined by each of apertures 514*a* and 514*b*. The size (e.g., length) of apertures 514*a* and 514*b* may be selected based on the type of switch 510*a* and 510*b* used, the desired available states for each switch, or any other suitable criteria. In some embodiments the sizes of apertures 514*a* and 514*b* may be different (for example because switches 510*a* and 510*b* may be different).

Figure 6:
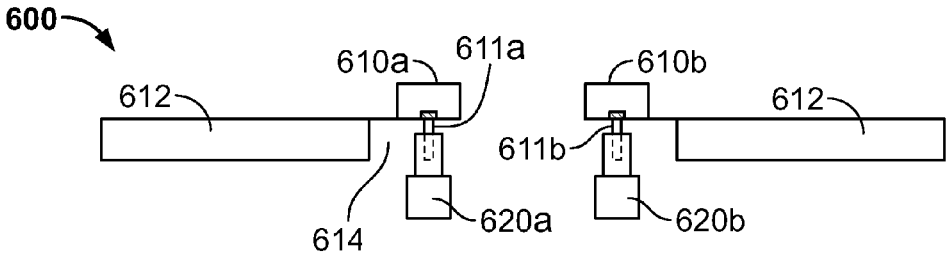
FIG. 6 is a schematic front view of a bottom actuated switch in accordance with one embodiment of the invention.

FIG. 6 is a schematic front view of a bottom actuated switch in accordance with yet another embodiment of the invention. Switches 610*a* and 610*b* may be mounted to the bottom surface of circuit board 612.

Switches 610*a* and 610*b* may include actuating pins 611*a* and 611*b*, respectively, which may be actuated by external actuators 620*a* and 620*b* to change the state of each of the switches 610*a* and 610*b*. Pins 611*a* and 611*b* may extend through the aperture 614 of circuit board 612, such that actuators 620*a* and 620*b* may engage pins 611*a* and 611*b* within the space defined by the aperture 614. The size (e.g., length) of the aperture 614 may be selected depending on the type of switch 610*a* and 610*b* used, the desired available states for each switch, or any other suitable criteria.

Variations, modifications, and other implementations of what is described may be employed without departing from the spirit and scope of the invention. More specifically, any of the method, system and device features described above or incorporated by reference may be combined with any other suitable method, system or device features disclosed herein or incorporated by reference, and is within the scope of the contemplated inventions. The systems and methods may be embodied in other specific forms without departing from the spirit or essential characteristics thereof. The foregoing embodiments are therefore to be considered in all respects illustrative, rather than limiting of the invention. The teachings of all references cited herein are hereby incorporated by reference in their entirety.

What is claimed is:

1. A switch assembly for a printed circuit board, comprising:

a printed circuit board having a top surface, a bottom surface and an aperture extending from the top surface to the bottom surface;

a switch mounted on the top surface overlapping the aperture, wherein the switch includes an actuating pin extending through the aperture towards the bottom surface; and an external actuator disposed on the bottom surface over the aperture, wherein the external actuator is removably attached to the actuating pin, and wherein a portion of the external actuator extends past the bottom surface toward the top surface.

2. The switch assembly of claim 1, wherein the switch includes a slide-switch and the aperture is adapted to allow the actuating pin to slide between different switch positions.

3. The switch assembly of claim 1, wherein the external actuator extends into the aperture.

4. The switch assembly of claim 1, wherein the actuating pin does not extend past the bottom surface.

5. The switch assembly of claim 1, wherein the switch includes a slide switch, and the aperture is adapted to allow a portion of the external actuator to slide between different switch positions.

6. The switch assembly of claim 1, wherein the printed circuit board includes a plurality of apertures, and a plurality of switches are mounted on the top surface overlapping each of the plurality of apertures.

7. The switch assembly of claim 1, wherein a plurality of external actuators are disposed on the bottom surface.

8. The switch assembly of claim 1, wherein a plurality of switches are mounted on the top surface of the printed circuit board, and the respective actuating pins of the plurality of switches extend through the aperture.

9. A switch assembly for an electronic device, comprising:

a housing having an opening on a surface;

a circuit board disposed in the housing and having an aperture near the opening;

a switch mounted on a surface of the circuit board that is distal to the opening and overlapping with the aperture, wherein the switch includes an actuating pin extending through the aperture; and an external actuator distinct from the actuating pin and disposed on a surface of the circuit board proximal to the opening and extending through the opening, wherein the external actuator extends through the aperture and couples to the pin for operating the switch.

10. The switch assembly of claim 9, wherein the electronic device has an overall thickness of about 5 mm.

11. The switch assembly of claim 9, wherein the opening is on a surface of the housing substantially parallel to the direction of the thickness of the electronic device.

12. The switch assembly of claim 11, wherein the circuit board is disposed in an orientation whereby the surface of the circuit board is substantially parallel to the surface of the housing that include the opening.

13. A method of manufacturing a switch for an electronic device, comprising:

providing a printed circuit board having top surface, a bottom surface and an aperture extending from the top surface to the bottom surface, wherein the aperture is located near a portion of the top surface having circuitry for switching;

providing a switch configured to be mounted on the top surface for connecting to the circuitry, the switch including an actuating pin adapted to extend in a direction substantially perpendicular to the top surface when the switch is mounted;

mounting the switch on the top surface and overlapping the aperture such that the actuating pin extends through the aperture and towards the bottom surface, and does not extend past the bottom surface; and coupling an external actuator to the actuating pin.

14. The method of claim 13, further comprising providing a housing having an opening on a surface.

15. The method of claim 14, further comprising enclosing the circuit board and the switch within the housing such that the external actuator extends through the opening on the surface of the housing.

16. A switch assembly for a printed circuit board, comprising:

a printed circuit board having a top surface, a bottom surface and an aperture extending from the top surface to the bottom surface; and a switch mounted on the top surface overlapping the aperture, wherein the switch includes an actuating pin extending through the aperture towards the bottom surface, wherein:

the switch assembly is placed within a housing comprising an opening on a surface, and the printed circuit board and the switch are disposed within the housing such that a portion of the actuating pin is accessible through the opening on the housing;

the switch includes a slide-switch; and the aperture is adapted to allow the actuating pin to slide between different switch positions.

17. The switch assembly of claim 16, wherein the printed circuit board includes a plurality of apertures, and a plurality of switches are mounted on the top surface overlapping the plurality of apertures.

* * * * *